US007934462B2

(12) United States Patent
Mansour et al.

(10) Patent No.: US 7,934,462 B2
(45) Date of Patent: May 3, 2011

(54) OFFSHORE FLOATING STRUCTURE WITH MOTION DAMPERS

(75) Inventors: Alaa M. Mansour, Houston, TX (US); Peter G. Wybro, Houston, TX (US)

(73) Assignee: Alaa Mansour, Houston, TX (US), part interest ( * ) Notice: Subject to any disclaimer, the term of this patent is extended or adjusted under 35 U.S.C. 154(b) by 0 days.

(21) Appl. No.: 12/399,904

(22) Filed: Mar. 6, 2009

(65) Prior Publication Data

US 2009/0235856 A1 Sep. 24, 2009

Related U.S. Application Data

(60) Provisional application No. 61/034,244, filed on Mar. 6, 2008.

(51) Int. Cl.
*B63B 39/00* (2006.01)

(52) U.S. Cl. ..... 114/264; 114/122

(58) Field of Classification Search ..... 114/264, 114/265, 122

See application file for complete search history.

(56) References Cited

U.S. PATENT DOCUMENTS

| | | | | |
|---|---|---|---|---|
| 3,986,471 | A * | 10/1976 | Haselton | 114/265 |
| 4,241,685 | A | 12/1980 | Mougin | |
| 4,498,412 | A | 2/1985 | Liden | |
| 6,012,873 | A * | 1/2000 | Copple et al. | 405/224 |
| 6,015,245 | A | 1/2000 | Frimm et al. | |
| 6,447,208 | B1 | 9/2002 | Huang et al. | |
| 6,503,023 | B2 | 1/2003 | Huang et al. | |
| 6,652,192 | B1 | 11/2003 | Xu et al. | |
| 6,666,624 | B2 * | 12/2003 | Wetch | 405/205 |
| 6,701,861 | B2 | 3/2004 | Key et al. | |
| 6,761,124 | B1 | 7/2004 | Srinivasan | |
| 7,140,317 | B2 | 11/2006 | Wybro et al. | |
| 7,156,040 | B2 | 1/2007 | Merchant et al. | |
| 7,219,615 | B2 | 5/2007 | Merchant et al. | |

* cited by examiner

*Primary Examiner* — Stephen Avila
(74) *Attorney, Agent, or Firm* — Kenneth A. Roddy

(57) ABSTRACT

A semi-submersible floating platform (10, 10A) for use in offshore applications has a semi-submersible hull structure (11) including support columns (12), a pontoon structure (13) adjoined to the lower ends thereof, and a deck structure (14) supported at an upper end of the columns for supporting the deck and equipment mounted thereon above the water surface. One or more passive damper weight members (15) are suspended below the hull by flexible connection members (16) at variable distances to provide hydrodynamic mass, damping, and in-water weight to the platform during operation, and the flexible connection members are maintained in tension by the damper weight(s) during operation.

17 Claims, 10 Drawing Sheets

OFFSHORE FLOATING STRUCTURE WITH MOTION DAMPERS

CROSS REFERENCE TO RELATED APPLICATION

This application claims priority of U.S. Provisional Application Ser. No. 61/034,244, filed Mar. 6, 2008.

BACKGROUND OF THE INVENTION

1. Field of the Invention

This invention relates generally to offshore floating vessels and platform structures and, more particularly, to a semi-submersible floating platform having a semi-submersible hull structure, with one or more passive damper weight members suspended below the hull by flexible connection members at variable distances to provide hydrodynamic mass, damping, and in-water weight to the platform during operation.

2. Background Art

Haselton, U.S. Pat. No. 3,986,471 discloses apparatus for damping vertical movement of a semi-submersible vessel having a small water plan area, whose buoyancy is provided substantially completely by submerged pontoon means and which includes at least one submerged damper plate supported deep beneath the vessel by flexible tensioned support elements, such as chains or cables and which has valves or similar flow controllers therein for providing substantially greater resistance to the upward movement of the plate than the downward movement. The area of the damper plate is several times larger than the water plane area of the vessel and provides low resistance to downward movement and higher resistance to upward movement.

Xu et. al, U.S. Pat. No. 6,652,192 discloses an apparatus for a heave suppressed floating offshore drilling and production platform having vertical columns, lateral trusses connecting adjacent columns, a deep submerged horizontal plate supported from the bottom of the columns by vertical truss legs and a topside deck supported by the columns. During the launch of the platform and towing in relatively shallow water the truss legs are stowed in shafts within each column and the plate is carried just below the lower end of the columns. After the platform has been floated to the deepwater site, the truss legs are lowered from the column shafts to lower the plate to deep draft for reducing the effect of wave forces and to provide heave and vertical motion resistance to the platform.

Wetch, U.S. Pat. No. 6,666,624 discloses a floating platform comprising an uppermost buoyant and ballastable hull partially submerged in water without contacting the floor of the body of water and usually without being moored to the floor of the body of water. The bottom of the uppermost hull is attached to the top of a lower buoyant and ballastable hull after the lower hull has been completely submerged and anchored to the floor of the body of water with flexible mooring.

Srinivasan, U.S. Pat. No. 6,761,124 discloses column stabilized floating structures having a deck and a plurality of vertical buoyant caissons bridged together in distantly spaced relation by plurality of open frame horizontal truss pontoon members and a vertical truss column at the lower end. The buoyancy of the caissons is selectively adjusted by means of ballast control. Water is selectively pumped into and out of the keel tanks at the bottom of the truss structure to raise or lower the center of gravity of the entire mass of the floating structure relative to the center of buoyancy to compensate for different operational, environmental and survival conditions.

Merchant et al, U.S. Pat. Nos. 7,156,040 and 7,219,615 disclose a semi-submersible vessel with a pair of vertically spaced pontoons with varied buoyancy. The lower pontoon is retained in a close vertical proximity to the upper pontoon when the vessel is in transit. The lower pontoon is ballasted at the deployment site dropping the pontoon to a depth of about 32 m below the first pontoon baseline to improve stability and motion characteristics of the vessel. The lower pontoon supports a plurality of vertically movable retractable legs that move through leg guides carried on the exterior of stabilizing columns and the upper pontoon. The legs ensure that the second tier pontoon is retained in a parallel relationship to the upper pontoon.

Liden, U.S. Pat. No. 4,498,412; Frimm et al, U.S. Pat. No. 6,015,245; Huang et al, U.S. Pat. Nos. 6,447,208 and 6,505,023; Key et al, U.S. Pat. No. 6,701,861; and Wybro et al, U.S. Pat. No. 7,140,317 disclose offshore floating platforms and vessels having vertical support columns and ring pontoon structures, but do not disclose passive damper weight members suspended below the hull by flexible connection members. Moougin, U.S. Pat. No. 4,241,685 and Horton U.S. Pat. No. 6,817,309 discloses single-column or spar-type offshore floating structures having a cylindrical column or tower divided into damping chambers, but do not disclose passive damper weight members suspended below the column or tower by flexible connection members.

SUMMARY OF THE INVENTION

The present invention is distinguished over the prior art in general, and these patents in particular, by a semi-submersible floating platform for use in offshore applications that has a semi-submersible hull structure including support columns, a pontoon structure adjoined to the lower ends thereof, and a deck structure supported at an upper end of the columns for supporting the deck and equipment mounted thereon above the water surface. One or more passive damper weight members are suspended below the hull by flexible connection members at variable distances to provide hydrodynamic mass, damping, and in-water weight to the platform during operation, and the flexible connection members are maintained in tension by the damper weight(s) during operation.

One of the features and advantages of the present semi-submersible platform having passive damper weight member (s) suspended beneath the platform by flexible connection members is that it can be used in both dry-tree and wet-tree applications and with flexible top tensioned risers or steel catenary risers.

Another feature and advantage of the present semi-submersible platform having passive damper weight member(s) suspended beneath the platform by flexible connection members is that it facilitates installation time and expense, by eliminating rigid structures connected between the damper weight member(s) and the hull.

Another feature and advantage of the present semi-submersible platform having passive damper weight member(s) suspended beneath the platform by flexible connection members is that it eliminates the significant bending moments that typically occur with rigid structures connected between the damper weight member(s) and the hull.

A further feature and advantage of the present semi-submersible platform having passive damper weight member(s) suspended beneath the platform by flexible connection members is that the passive damper weight is located a sufficient distance below the waterline to provide significant hydrodynamic mass and damping and in-water weight during operation which increases the platform heave natural period and improves platform stability, which provide significant reduction to the platform heave and rotational motion and consequently enables the use of the top tensioner risers.

Other features and advantages of the present invention will become apparent from time to time throughout the specification and claims as hereinafter related.

DESCRIPTION OF THE PREFERRED EMBODIMENTS

Figure 1:
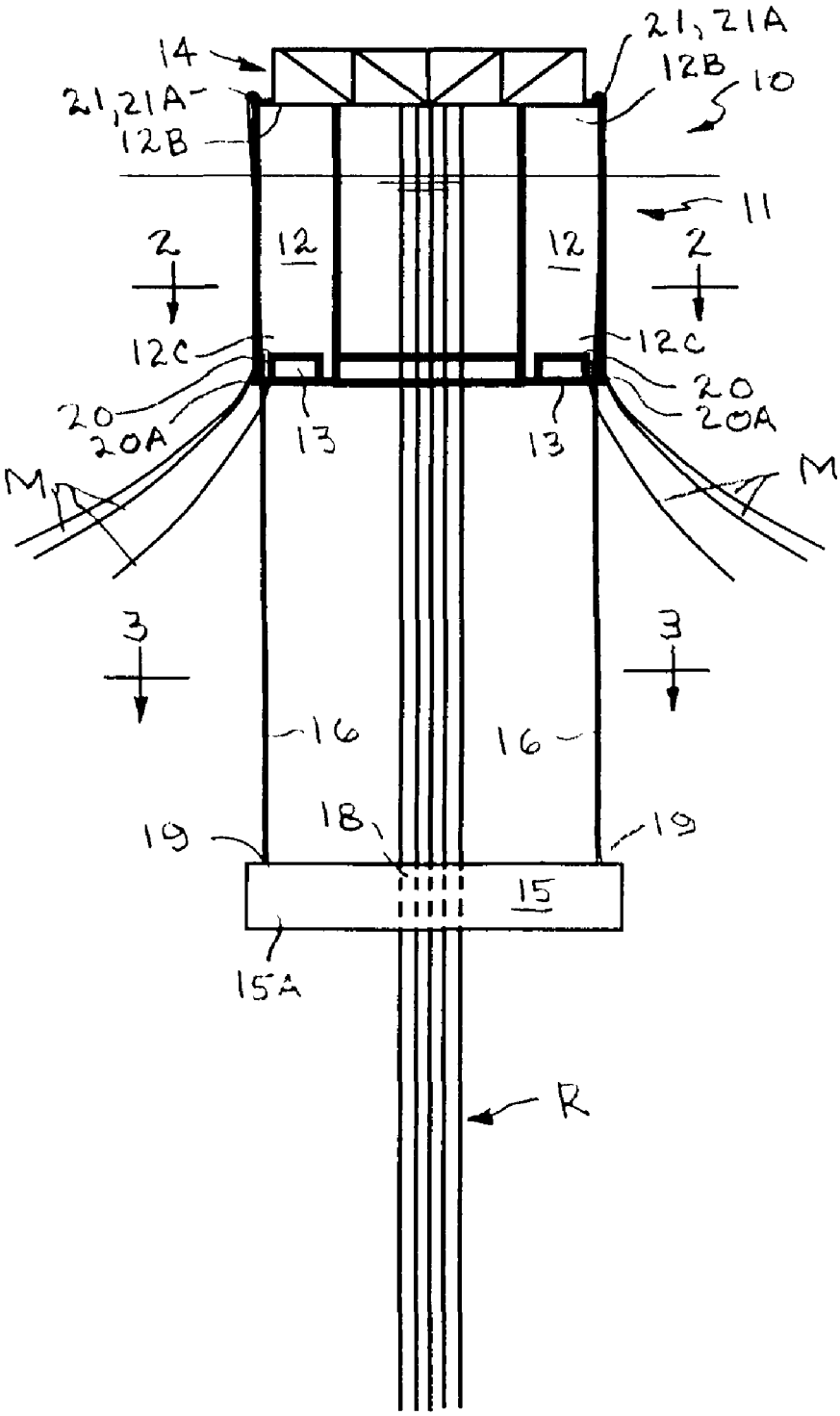
FIG. 1 is a side elevation view showing, somewhat schematically, a semi-submersible floating platform in accordance with a first embodiment of the present invention.
Figure 2:
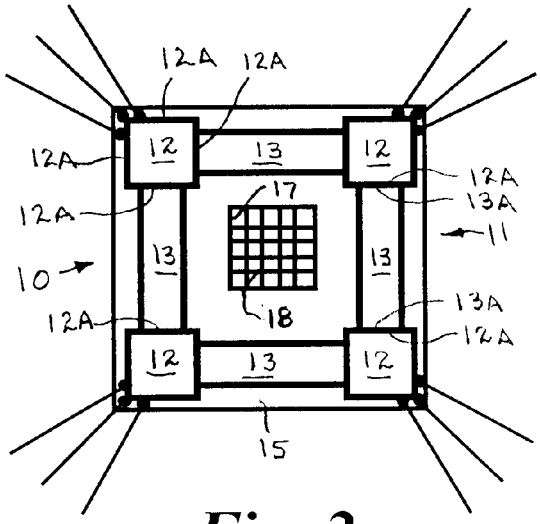
FIG. 2 is a transverse cross sectional view of the platform taken along lines 2-2 of FIG. 1, showing the column and pontoon arrangement.
Figure 3:
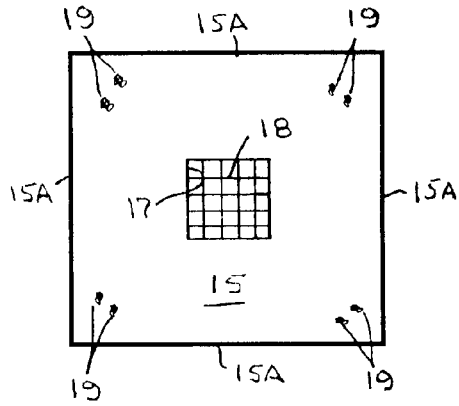
FIG. 3 is a transverse cross sectional view of the platform taken along lines 3-3 of FIG. 1, showing the damper weight member from the top side.

Referring to the drawings by numerals of reference, there is shown in FIGS. 1-3, a semi-submersible floating platform 10 in accordance with a first multi-column embodiment of the present invention for use in offshore applications, such as for offshore oil and gas drilling and production. The platform 10 has a hull 11 including support columns 12 having a generally a quadrilateral transverse cross section, which may be a generally rectangular or trapezoidal shaped configuration, and a generally rectangular ring-shaped pontoon structure 13 disposed between the support columns at a lower end thereof. The columns 12 and pontoons 13 are constructed substantially of flat metal plate.

Each of the support columns 12 has a generally rectangular transverse cross section formed of opposed parallel spaced sidewalls 12A, and upper and lower ends 12B and 12C. Each side of the pontoon structure 13 has a generally rectangular transverse cross section with opposed parallel spaced inboard and outboard side walls, top and bottom walls, and opposed ends 13A which are joined to the lower ends 12C of the opposed facing side walls 12A of the support columns 12. A deck structure 14 is supported at the upper ends 12B of the support columns 12 for supporting drilling and production equipment, or other facilities for the particular application, mounted thereon above the water surface.

The pontoon structure 13 has been shown as a generally rectangular ring pontoon structure, purposes of example only, and is not limited thereto. It should be understood that various other types of pontoon structures may be utilized; for example, truss pontoons attached at the base of each support column with horizontal trusses connecting each pair of adjacent pontoons. The columns have also been shown as having a generally rectangular transverse cross section, for purposes of example only. It should be understood that the columns may have various other transverse configurations, for example, they may have a circular or other trapezoidal shaped cross section.

The central longitudinal axis or centerline of each support column 12 may be oriented perpendicular to and intersect the axial horizontal centerline of the pontoon structure 13 adjoined at the lower end of the support columns and extend upwardly therefrom in a generally vertical orientation, or, the columns may be battered or inclined angularly inward toward the central longitudinal axis of the hull. The vertical or battered support columns may also be stepped to provide different cross sectional areas along their length.

A passive damper weight member 15 is suspended below the hull 11 by a plurality of flexible connection members 16 or tendons that are connected at upper ends to the hull structure and at lower ends to the damper weight member for suspending the damper weight member at a distance beneath the hull structure to provide hydrodynamic mass, damping, and in-water weight to the platform during operation, as described hereinafter. The flexible connection members 16 are maintained in tension by the damper weight member 15 during operation.

The damper weight member 15 has a generally a generally rectangular ring-shaped configuration with box-shaped sides 15A of generally rectangular transverse cross section surrounding a central opening 17. Each of the damper weight member sides has opposed inboard and outboard side walls, and opposed top and bottom side walls. As best seen in FIGS. 2 and 3, a riser guide 18 may be disposed in the central opening 17 of the damper weight member 15 for receiving and guiding one or more production risers R through the damper weight member, as described below.

Figure 4:
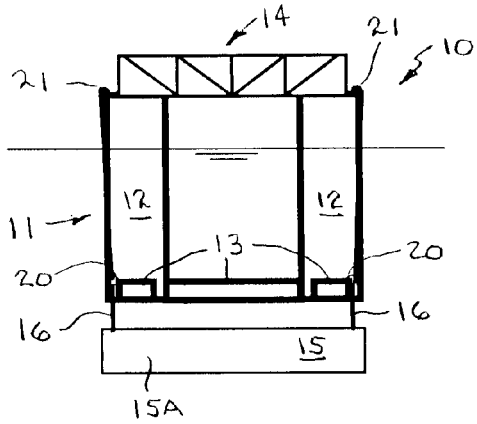
FIG. 4 is a side elevation view showing the damper weight member in a retracted position closely adjacent to the lower end of the platform.

In the embodiment of FIG. 1, the flexible connection members 16 are each pivotally connected at a lower end to the damper weight member 15 by suitable means, such as padeyes 19 mounted near the corners of the damper weight member (FIG. 3), and extend through respective guide members, such as fairleads 20 mounted at a lower end of the hull, and are connected at an upper end to a respective line extension and retraction device 21, such as a winch or chain jack disposed on the deck or upper end of the columns 12 for taking up and feeding out the flexible connection members to selectively position the damper weight member 15 between a raised position in close proximity to the pontoon structure 13 and lowered positions at selected distances beneath the pontoon structure. The damper weight member 15 has sufficient in-water weight to maintain the flexible connection members 16 in tension during operation. As best seen in FIG. 4 during a transit or transport operation, the winches or chain jacks 21 are operated to raise the damper weight member 15 to reside in close proximity to the lower end of the semi-submersible hull 11.

The production risers R, which are attached at a lower end to a wellhead on the seabed and, in the illustrated example are top tensioned risers, pass through the riser guide 18 and are supported at an upper end by the deck structure 14, and the risers are connected with hydrocarbon production equipment on the deck structure in a conventional known manner.

Thus, with the present hull configuration, the passive damper weight 15 is located a sufficient distance below the waterline to provide significant hydrodynamic mass and damping and in-water weight during operation which increases the platform heave natural period and improves platform stability, which provide significant reduction to the platform heave and rotational motion and consequently enables the use of the top tensioner risers. Reducing the platform heave and rotational motion also facilitates the support of steel catenary and flexible risers. These features provide significant advantages over conventional floating production semi-submersible platform designs, which typically do not have a passive motion damper weight pivotally connected through flexible connectors members to the semi-submersible hull.

The interior of both the columns 12 and the pontoon structure 13 may be subdivided by bulkheads to strengthen the structures, to provide enclosed spaces for locating and storing various equipment (e.g., anchors, chains, propulsion mechanisms, etc.), and to provide a plurality of separate compartments for purposes of ballasting the platform and storing various fluids and other materials which may be required or desired during drilling or production by the well. One or more of the interior compartments may be used for storage of petroleum products so as to enable the platform as a floating production storage and offloading facility (FPSO). Conventional ballast control means, pumps and piping systems are provided for selectively pumping water into and out of the compartments of the columns and pontoon structure to adjust the weight and ballast. Such ballast control means, pumps and piping systems are conventional and well known in general shipboard and submarine ballast design practice, and therefore not shown or described in detail.

The platform structure 10 may be anchored by a plurality of mooring lines M extending through fairleads 20A mounted on the lower end of the outboard side wall of the support columns 12 with the upper ends of the lines extending generally parallel upwardly along the outboard sidewall to mooring winches 21A on the deck or upper ends of the columns and their lower ends extending radially outward and downward from the fairleads and anchored to the sea bed. With the present mooring system, the mooring loads do not cause substantial restraint against the vertical and rotational motions of the platform and the damper weight member provides improved rotational stability with changes in the direction of wind, wave and currents.

Figure 5:
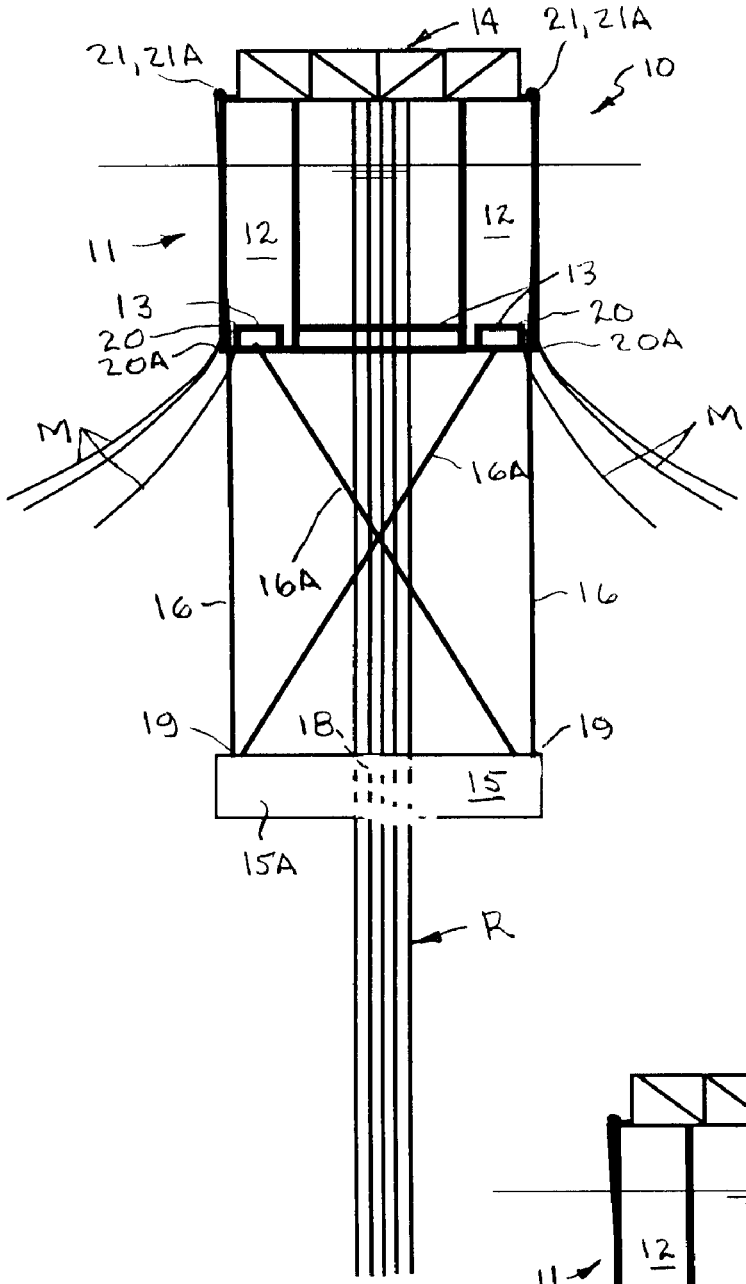
FIG. 5 is a side elevation view showing the damper weight member suspended a distance below the lower end of the platform by the flexible connection members, and reinforced by diagonal auxiliary flexible connection members.
Figure 6:
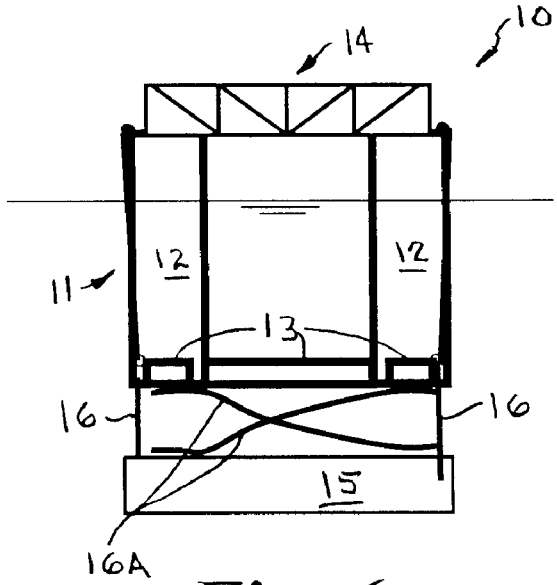
FIG. 6 is a side elevation view showing the damper weight member in a retracted position with the auxiliary flexible connection members in a stowed position.

FIG. 5 is a side elevation view showing, schematically, the damper weight member 15 suspended a distance below the lower end of the platform 10 by the flexible connection members 16, and further reinforced by auxiliary flexible connection members 16A extending diagonally between the lower end of the platform and the damper weight member. FIG. 6 shows the platform 10 with the damper weight member 15 in a retracted transport position with the auxiliary flexible connection members 16 in a stowed position between the bottom of the hull 11 and the top side of the damper weight member.

Figure 7:
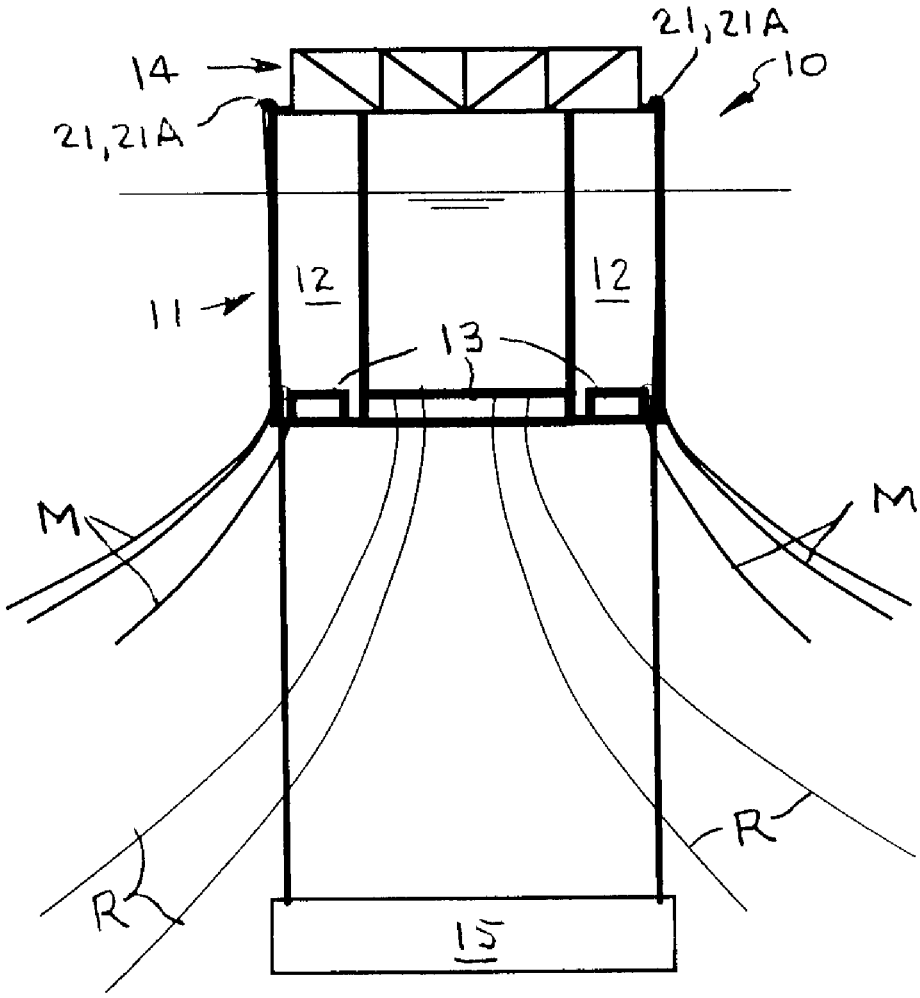
FIG. 7 is a side elevation view showing the damper weight member suspended a distance below the lower end of the platform and maintained in position by mooring lines with upper portions of risers supported at the lower end of the platform.

FIG. 7 shows the platform 10 with the damper weight member suspended a distance below the lower end of the platform and maintained in position by mooring lines M with upper portions of steel catenary risers R supported at the lower end of the platform rather than the deck level.

Figure 8:
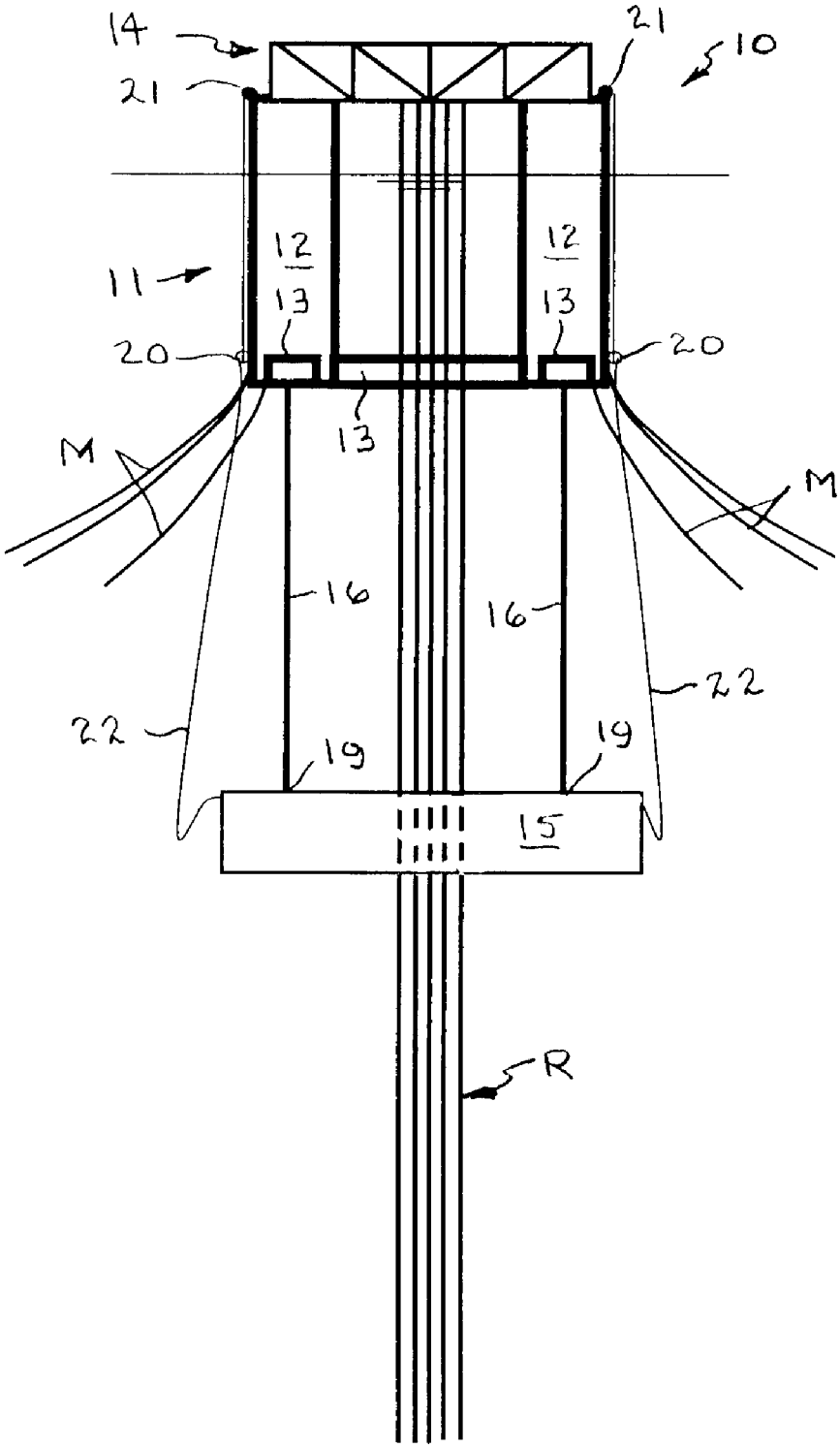
FIG. 8 is a side elevation view showing a modification of the platform wherein the damper weight member is raised and lowered by winches on the decks and suspended a distance below the lower end of the platform by flexible connection members with upper portions of risers supported at the upper end of the platform.
Figure 9:
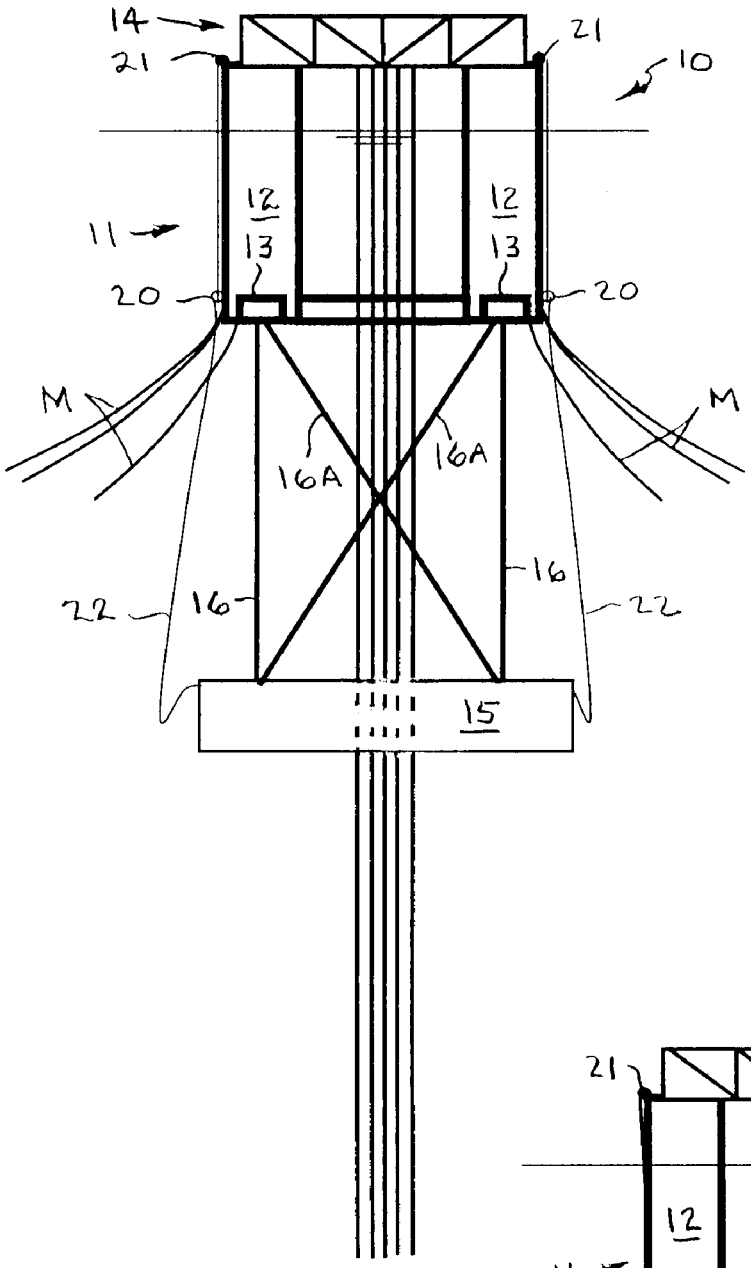
FIG. 9 is a side elevation view of the platform of FIG. 8, showing the damper weight member suspended a distance below the lower end of the platform by the flexible connection members, and reinforced by diagonal auxiliary flexible connection members.
Figure 10:
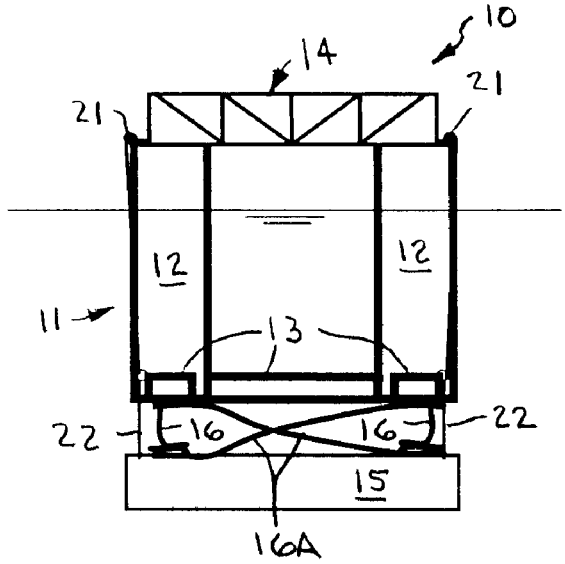
FIG. 10 is a side elevation view of the platform of FIG. 8, showing the damper weight member in a retracted position with the flexible connection members in a stowed position.

Referring now to FIGS. 8, 9 and 10, there is shown a modification of the platform 10 wherein the damper weight member 15 is raised and lowered by cables or lines 22. In this modification, the cables or lines 22 are connected at lower ends to the damper weight member 15 and extend through respective fairleads 20A at the lower end of the columns 12 and their upper ends are wound on respective winches 21 mounted on the deck or upper portion of the columns 12, whereby the winches 21 take up and feed out the cables or lines 22 to selectively position the damper weight member 15 between a raised position in close proximity to the pontoon structure 13 and lowered positions at selected distances beneath the pontoon structure. Also, in this modification, the plurality of flexible connection members 16 or tendons are pivotally connected between the bottom of the hull structure 11 and the damper weight member 15 to suspend the damper weight member at a distance beneath the hull structure. The cables or lines 22 are slack, and the damper weight member 15 maintains the flexible connection members 16 in tension during operation. FIG. 9 shows the damper weight member 15 suspended a distance below the lower end of the platform by the flexible connection members 16, and further reinforced by auxiliary flexible connection members 16A extending diagonally between the lower end of the platform and the damper weight member. FIG. 10 shows the platform 10 with the damper weight member 15 in a retracted transport position with the auxiliary flexible connection members 16 in a stowed position between the bottom of the hull 11 and the top side of the damper weight member.

Figure 11:
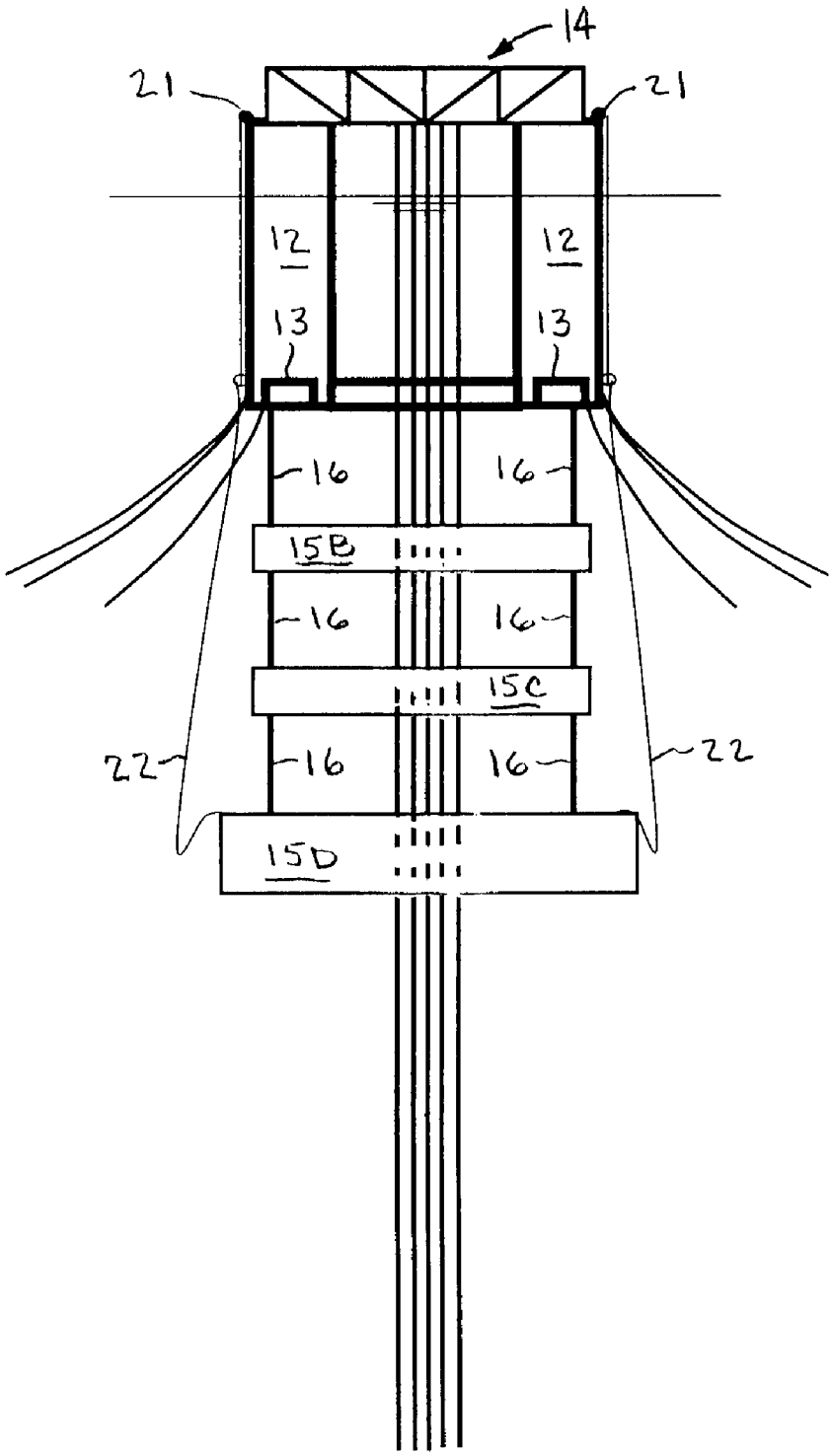
FIG. 11 is a side elevation view of the platform of FIG. 8, showing a plurality of damper weight members suspended a distance below the lower end of the platform in vertically spaced relation by flexible connection members extending therebetween in a generally axially aligned arrangement.
Figure 12:
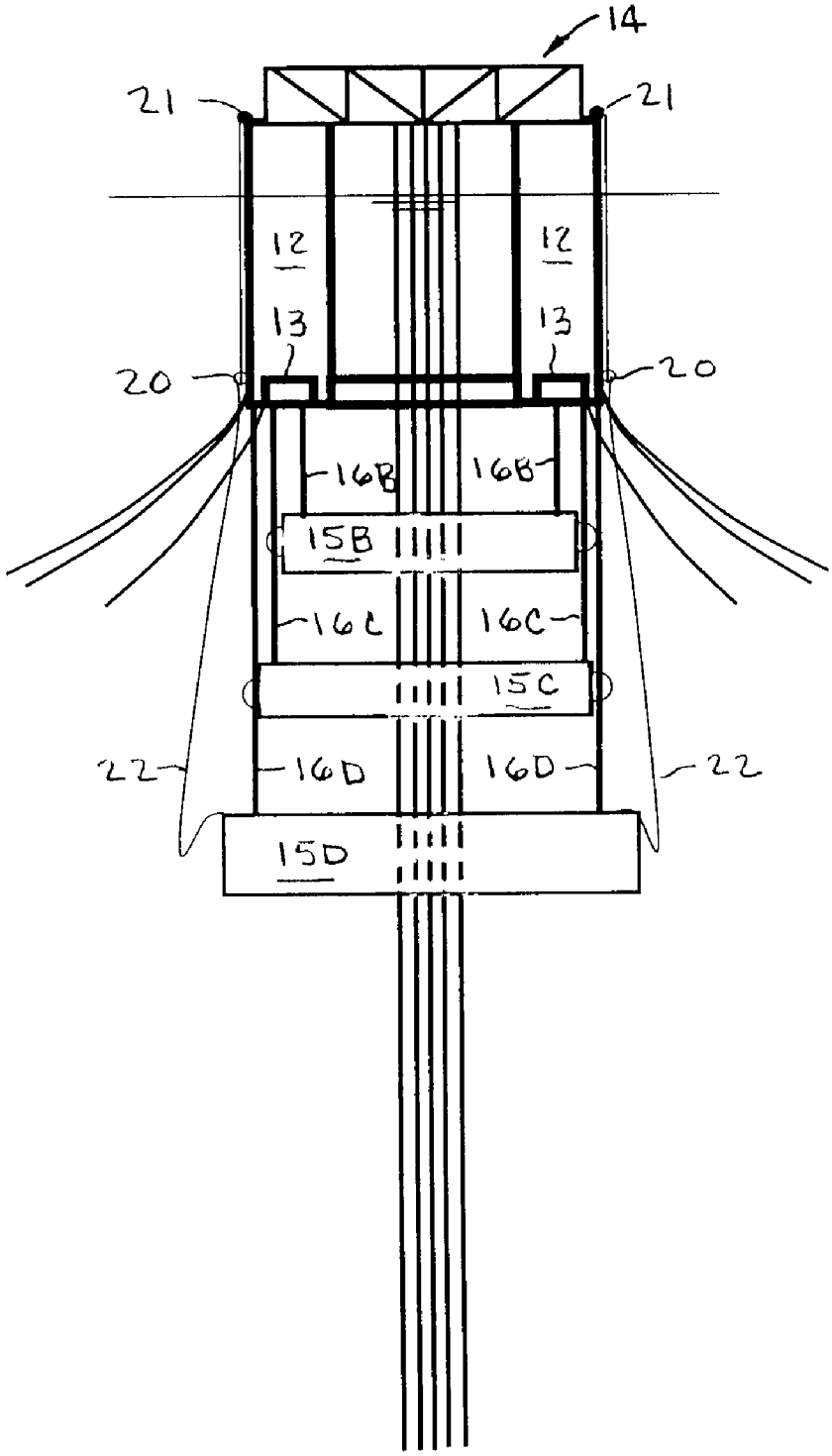
FIG. 12 is a side elevation view of the platform of FIG. 8, showing a plurality of damper weight members suspended a distance below the lower end of the platform in vertically spaced relation by flexible connection members extending between the lower end of the platform and the damper weight members in a generally parallel arrangement.
Figure 13:
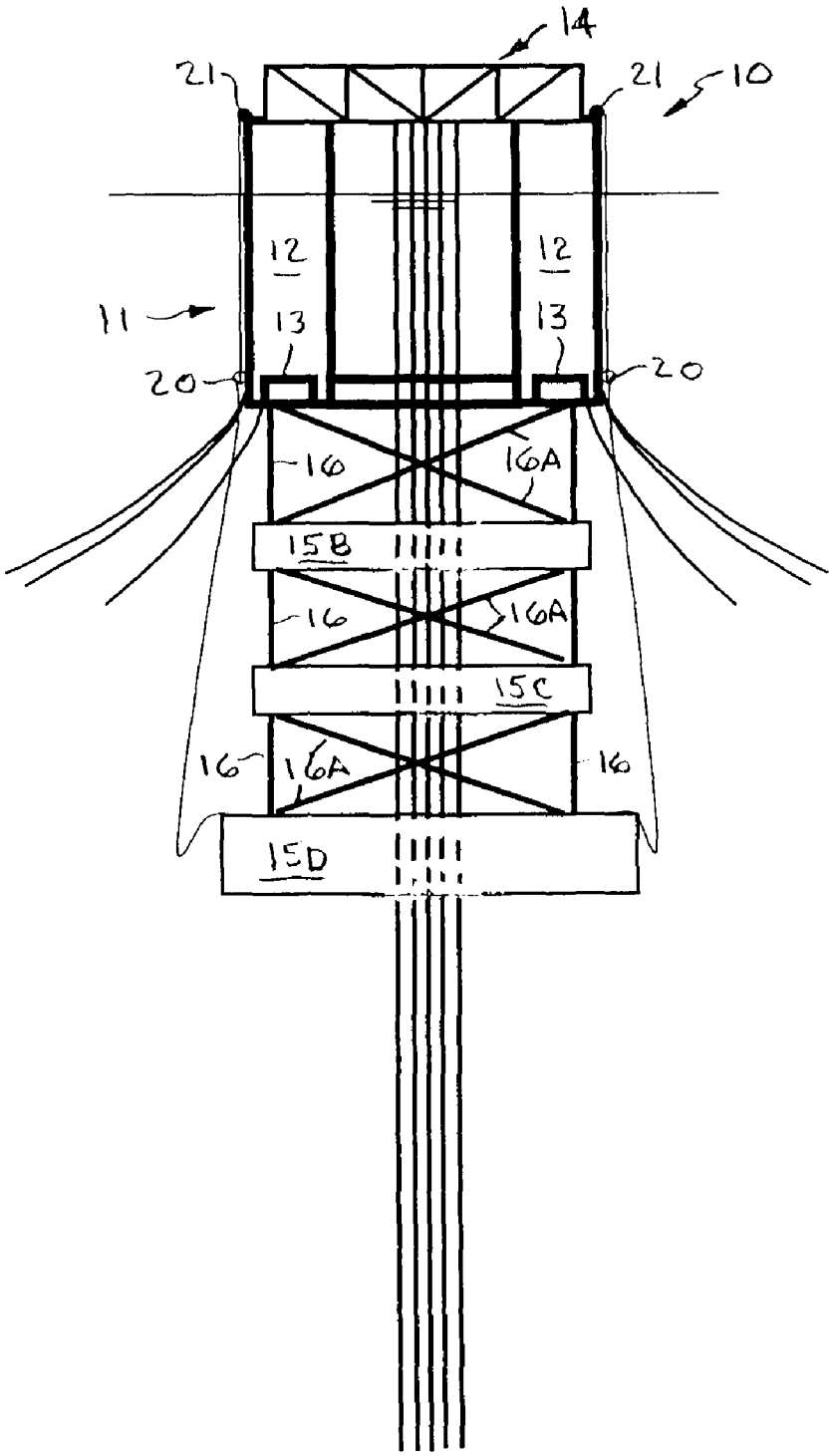
FIG. 13 is a side elevation view of the platform of FIG. 11, with the damper weight members suspended a distance below the lower end of the platform in vertically spaced relation by the generally axially aligned flexible connection members, and reinforced by diagonal auxiliary flexible connection members.

Referring now to FIGS. 11, 12 and 13, there is shown another modification of the platform 10 wherein a plurality of damper weight members 15B, 15C, and 15D are suspended a distance below the lower end of the platform in vertically spaced relation by a plurality of the flexible connection members 16 in various arrangements, and are raised and lowered by winches and cables or lines 22, as described above. The components that are the same as described above are assigned the same numerals of reference, but will not be described again in detail to avoid repetition.

As shown in FIG. 11, in one arrangement, an upper plurality of flexible connection members 16 are pivotally connected at upper ends to the bottom of the hull structure and at lower ends to the uppermost damper weight member 15B, and an intermediate plurality of flexible connection members 16 are pivotally connected at upper ends and lower ends to damper weight members 15C and 15D disposed in vertically spaced relation to the uppermost damper weight member 15B and to one another in a generally axially aligned orientation.

In another arrangement, shown in FIG. 12, a plurality of flexible connection members 16B, 16C and 16D of different lengths are pivotally connected at upper ends to the bottom of the hull structure. The lower ends of the plurality of shorter flexible connection members 16B are pivotally connected to the uppermost damper weight member 15B, the lower ends of the plurality of intermediate length flexible connection members 16C are pivotally connected to the intermediate damper weight member 15C, and the lower ends of the plurality of the longer flexible connection members 16D are pivotally connected to the lowermost damper weight member 15D.

FIG. 13 shows the platform 10 with the arrangement of the plurality of flexible connection members 16 pivotally connected between the bottom of the hull 11 and the uppermost damper weight member 15B, and the damper weight members 15C and 15D disposed in the vertically spaced generally axially aligned orientation as shown in FIG. 11, and further reinforced by auxiliary flexible connection members 16A extending diagonally between the lower end of the platform and the uppermost damper weight member 15B, and between the intermediate and lowermost damper weight members 15C and 15D.

Figure 14:
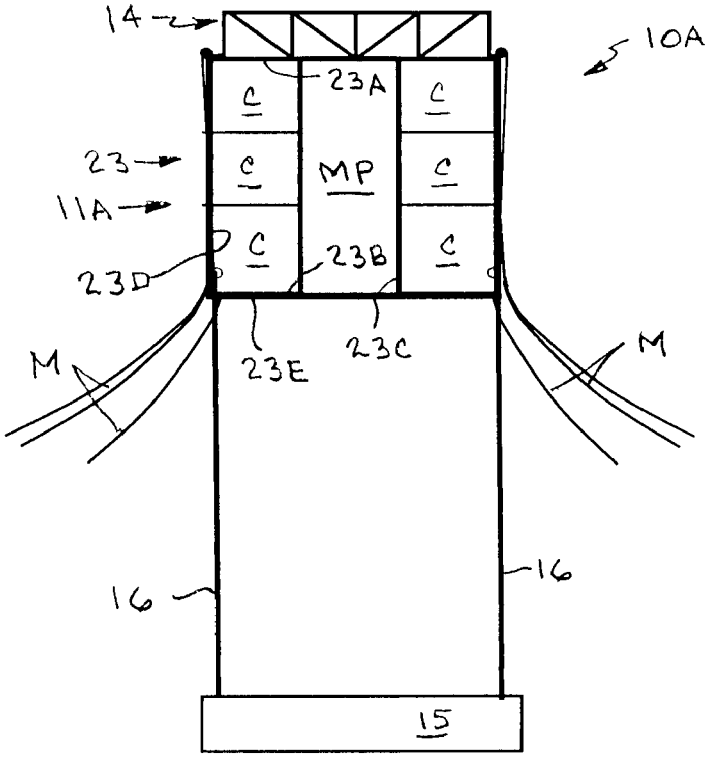
FIG. 14 is a side elevation view showing, somewhat schematically, a single-column semi-submersible floating platform embodiment of the present invention having interior compartments.
Figure 15:
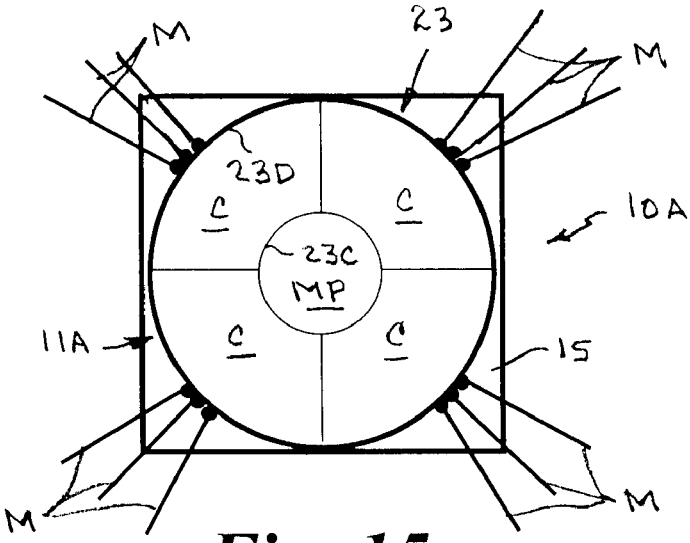
FIG. 15 is a transverse cross sectional view of the single-column platform taken along lines 15-15 of FIG. 14, showing the interior compartments.

FIGS. 14 and 15 show somewhat schematically, a single-column semi-submersible floating platform embodiment 10A of the present invention. The components that are the same as described above in the previous embodiments are assigned the same numerals of reference, but will not be described again in detail to avoid repetition. The single-column platform 10A has a hull structure 11A that includes a central, substantially vertically disposed, column 23 having an upper end 23A and a lower end 23B, and a deck structure 14 supported at the upper end of the column for supporting the deck and equipment mounted thereon above the water surface. The column 22 has concentric cylindrical inner and outer walls 23C and 23D defining an annulus therebetween enclosed at a lower end by a bottom wall 23E. The inner wall 23C surrounds and defines a central, substantially vertically disposed opening or moon pool MP.

As with the previous embodiments, a passive damper weight member 15 is suspended below the column 23 by a plurality of flexible connection members 16 or tendons that are connected at upper ends to the column and at lower ends to the damper weight member for suspending the damper weight member at a distance beneath the column to provide hydrodynamic mass, damping, and in-water weight to the platform during operation, as described previously. The flexible connection members 16 are maintained in tension by the damper weight member 15 during operation, and a riser guide may be disposed in the central opening of the damper weight member, as described previously. The flexible connection members 16 may be pivotally connected between the column and the damper weight member 15 by either of the methods as previously described.

It should be understood that the single-column embodiment 10A may also utilize a plurality of damper weight members suspended a distance below the lower end of the column in vertically spaced relation by flexible connection members extending between the lower end of the platform and the damper weight members in either of a generally axially aligned or a generally parallel arrangement, and may be reinforced by diagonal auxiliary flexible connection members, as described above with reference to the previous embodiments.

The annulus between the inner and outer walls 23C and 23D is divided into interior compartments C arranged in vertically and circumferentially adjacent relation for ballasting and de-ballasting the hull structure to adjust the draft and center of gravity of the platform. One or more of the interior compartments C may be used for storage of petroleum products. Thus, the single-column platform may be used as a floating production storage and offloading facility (FPSO). Conventional ballast control means, pumps and piping systems are provided for selectively pumping water into and out of the compartments of the column structure to adjust the weight and ballast. Such ballast control means, pumps and piping systems are conventional and well known in general shipboard and submarine ballast design practice, and therefore not shown or described in detail.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A semi-submersible floating platform for use in offshore applications, comprising:

a semi-submersible hull structure including support columns, a pontoon structure adjoined to said support columns at a lower end thereof, and a deck structure supported at an upper end of said columns for supporting said deck and equipment mounted thereon above the water surface; and passive damper weight means disposed below said hull for providing hydrodynamic mass, damping, and in-water weight, said damper weight means including at least one generally rectangular ring-shaped damper weight member having box-shaped sides of generally rectangular transverse cross section surrounding a central opening;

a plurality of flexible connection members connected at upper ends to said hull structure and at lower ends to said at least one damper weight member for suspending said at least one damper weight member at a distance beneath said hull structure to provide hydrodynamic mass, damping, and in-water weight to said platform during operation, and said flexible connection members being maintained in tension by said at least one damper weight member during operation; and riser guide means disposed in said at least one damper weight member central opening for receiving and guiding through said damper weight member a portion of at least one riser attached at a lower end to a wellhead on the seabed and supported at an upper end by said deck structure for connection with hydrocarbon production equipment on said deck structure.

2. The semi-submersible floating platform according to claim 1, wherein said pontoon structure is adjoined to said lower ends of said support columns to define a generally ring-shaped pontoon structure; and said support columns extend upwardly from said pontoon structure in either of a vertical orientation generally parallel with a central longitudinal axis of said hull or a battered orientation inclined angularly inwardly toward the central longitudinal axis of the hull structure.

3. The semi-submersible floating platform according to claim 1, wherein said upper and lower ends of said flexible connection members are pivotally connected between said hull structure and said at least one damper weight member to extend therebetween in either or both of a generally vertical orientation or an inclined orientation.

4. The semi-submersible floating platform according to claim 1, wherein said flexible connection members are each connected at a lower end to said at least one damper weight member, extend through respective guide members at a lower end of said hull, and are connected at an upper end to a respective line extension and retraction device disposed on said deck for taking up and feeding out said flexible connection members to selectively position said at least one damper weight member between a raised position in close proximity to said pontoon structure and lowered positions at selected distances beneath said pontoon structure.

5. The semi-submersible floating platform according to claim 1, further comprising:

raising and lowering means comprising a plurality of line guide means on said hull structure, a plurality of lines, each extending through a respective said line guide means and connected at a lower end to said damper weight means and at an upper ends to a respective line extension and retraction device disposed on said deck for taking up and feeding out said lines to selectively position said at least one damper weight member between a raised position in close proximity to said pontoon structure and lowered positions at selected distances beneath said pontoon structure.

6. The semi-submersible floating platform according to claim 1, wherein said damper weight means comprises a plurality of said generally rectangular ring-shaped damper weight members disposed in generally parallel vertically spaced relation; and said plurality of flexible connection members are pivotally connected at upper ends to said hull structure and at lower ends to said plurality of said vertically spaced damper weight members for suspending said damper weight members at a distance beneath said hull structure and relative to one another to provide hydrodynamic mass, damping, and in-water weight to said platform during operation.

7. The semi-submersible floating platform according to claim 6, wherein said flexible connection members comprise an upper plurality of said flexible connection members pivotally connected at upper ends to said hull structure and at lower ends to an uppermost one of said vertically spaced damper weight members, and an intermediate plurality of said flexible connection members pivotally connected at upper ends and lower ends to damper weight members disposed in vertically spaced relation to said uppermost damper weight member and to one another.

8. The semi-submersible floating platform according to claim 1, further comprising:

station keeping means connected with said support columns for maintaining said platform above a subsea location.

9. The semi-submersible floating platform according to claim 8, wherein said station keeping means is a laterally spread mooring system comprising a plurality of mooring lines having upper portions extending downwardly from mooring winches or chain jacks on said deck, along an outer side wall of said columns, through fairleads at lower ends of the outer side wall, and lower portions extending radially outward and downward from said fairleads and anchored to the seabed.

10. The semi-submersible floating platform according to claim 1, wherein either of said support columns or said pontoon structure or both are divided into interior compartments for ballasting and de-ballasting said hull structure to adjust draft and center of gravity and optional storage of petroleum products.

11. A semi-submersible floating platform for use in offshore applications, comprising:

a semi-submersible hull structure including a central, substantially vertically disposed, column having an upper end and a lower end, and a deck structure supported at an upper end of said column for supporting said deck and equipment mounted thereon above the water surface;

said column having concentric cylindrical inner and outer walls defining an annulus therebetween enclosed at a lower end which is divided into interior compartments for ballasting and de-ballasting said hull structure to adjust draft and center of gravity and optional storage of petroleum products; and passive damper weight means disposed below said column lower end for providing hydrodynamic mass, damping, and in-water weight, said damper weight means including at least one generally rectangular ring-shaped damper weight member having box-shaped sides of generally rectangular transverse cross section surrounding a central opening;

a plurality of flexible connection members connected at upper ends to said column and at lower ends to said at least one damper weight member for suspending said at least one damper weight member at a distance beneath said column to provide hydrodynamic mass, damping, and in-water weight to said platform during operation, and said flexible connection members being maintained in tension by said at least one damper weight member during operation; and riser guide means disposed in said at least one damper weight member central opening for receiving and guiding through said damper weight member a portion of at least one riser attached at a lower end to a wellhead on the seabed and supported at an upper end by said deck structure for connection with hydrocarbon production equipment on said deck structure.

12. The semi-submersible floating platform according to claim 11, wherein said upper and lower ends of said flexible connection members are pivotally connected between said column and said damper weight means to extend therebetween in either or both of a generally vertical orientation or an inclined orientation.

13. The semi-submersible floating platform according to claim 11, further comprising:

raising and lowering means comprising a plurality of line guide means on said column, a plurality of lines, each extending through a respective said line guide means and connected at a lower end to said damper weight means and at an upper ends to a respective line extension and retraction device disposed on said deck for taking up and feeding out said lines to selectively position said damper weight means between a raised position in close proximity to said column lower end and lowered positions at selected distances beneath said column lower end.

14. The semi-submersible floating platform according to claim 11, wherein said damper weight means comprises a plurality of said generally rectangular ring-shaped damper weight members disposed in generally parallel vertically spaced relation; and said plurality of flexible connection members are pivotally connected at upper ends to said hull structure and at lower ends to said plurality of said vertically spaced damper weight members for suspending said damper weight members at a distance beneath said hull structure and relative to one another to provide hydrodynamic mass, damping, and in-water weight to said platform during operation.

15. The semi-submersible floating platform according to claim 14, wherein said flexible connection members comprise an upper plurality of said flexible connection members pivotally connected at upper ends to said hull structure and at lower ends to an uppermost one of said vertically spaced damper weight members, and an intermediate plurality of said flexible connection members pivotally connected at upper ends and lower ends to damper weight members disposed in vertically spaced relation to said uppermost damper weight member and to one another.

16. The semi-submersible floating platform according to claim 11, further comprising:

station keeping means connected with said column for maintaining said platform above a subsea location.

17. The semi-submersible floating platform according to claim 16, wherein said station keeping means is a laterally spread mooring system comprising a plurality of mooring lines having upper portions extending downwardly from mooring winches on said deck, along an outer side wall of said column, through fairleads at lower ends of the outer side wall, and lower portions extending radially outward and downward from said fairleads and anchored to the seabed.

* * * * *